US005313909A

United States Patent [19]

Tseng et al.

[11] Patent Number: 5,313,909

[45] Date of Patent: May 24, 1994

[54] BRUSH FILAMENTS

[75] Inventors: Mingchih M. Tseng, Hingham; Philip J. Sweeney, Brockton, both of Mass.

[73] Assignee: Gillette Canada Inc., Kirkland, Canada

[21] Appl. No.: 971,784

[22] Filed: Nov. 5, 1992

[51] Int. Cl.[5] ..... G01D 13/00; A46B 9/06

[52] U.S. Cl. ..... 116/208; 116/200; 15/167.1

[58] Field of Search ..... 15/167.1, 167.2, 207.2; 116/200, 201, 208; 132/308, 309, 310, 311, 321, 329

[56] References Cited

U.S. PATENT DOCUMENTS

| | | | |
|---|---|---|---|
| Re. 26,688 | 10/1969 | Lemelson | 15/209.1 |
| 2,328,998 | 9/1943 | Radford | 15/207.2 |
| 3,016,554 | 11/1962 | Peterson | 15/207.2 |
| 3,258,805 | 7/1966 | Rossnan | 15/110 |
| 3,327,339 | 6/1967 | Lemelson | 15/207.2 |
| 3,403,070 | 9/1968 | Lewis | 15/207.2 |
| 4,263,691 | 4/1981 | Pakarnseree | 15/207.2 |
| 4,623,495 | 11/1986 | Degoix et al. | 264/1.5 |
| 4,802,255 | 2/1989 | Breuer et al. | 15/207.2 |

FOREIGN PATENT DOCUMENTS

| | | | |
|---|---|---|---|
| 92/04589 | 12/1992 | PCT Int'l Appl. . | |
| 2137080 | 10/1984 | United Kingdom | 15/207.2 |

*Primary Examiner*—William A. Cuchlinski, Jr.
*Assistant Examiner*—W. Morris Worth

[57] ABSTRACT

The invention provides novel, improved wear indicating brush filaments and novel, improved coextrusion process for their manufacture. Essentially, the filaments of the present invention are coextruded filaments which include a longitudinal surface providing a boundary about the cross-sectional area of the filament and the longitudinal surface and/or the cross-sectional area presents a two colored region adapted to provide a visual signal indicative of wear in response to filament use. The filaments can be natural or synthetic materials. In filaments of the present invention, the colored region provides an initial color or color intensity viewable to the user. As wear is produced by continuing use of the filaments, the intensity of the colored region changes to a point which signals the user that the filament no longer provides the requisite performance characteristics for effectively performing its assigned function.

6 Claims, 3 Drawing Sheets

BRUSH FILAMENTS

BACKGROUND OF THE INVENTION

1. The Field of the Invention

This invention relates to filaments (or fibers) for brushes. More precisely, this invention relates to novel, improved filaments for oral care brushes and to oral care brushes including the novel improved filaments.

2. Description of the Prior Art

Brushing the teeth is universally recommended as the most effective way to maintain oral hygiene. While there is disagreement as to the most suitable form of brushing, the toothbrush is acknowledged to be the most effective aid in cleaning the teeth. In turn, the cleaning effectiveness of a toothbrush is dependent on such factors as the brushing habits of the user, the frequency, intensity and duration of brushing and the quality of the brush filaments. There is considerable debate in the art relating to the features which provide a toothbrush having maximized cleaning effectiveness. These factors include the material, size, shape, strength and resiliency of the brush filament and the length, width and overall shape and area of the brushing surface. Other features affecting the cleaning effectiveness of a toothbrush include the number of tufts (bundles of individual filaments), the number of rows of tufts and the arrangement of the tufts on the brush head. However there is general agreement in the art that wear is a crucial factor which can dramatically diminish the effectiveness of a toothbrush in maintaining oral hygiene. For example, the art recognizes and acknowledges that diminished effectiveness of a toothbrush by wear can result in increased plaque accumulation and increased risks to periodontium tissue.

The degree of wear of a toothbrush is primarily a function of the properties of the filament and the mechanical force applied to the brush during brushing. The degree of wear can also be accelerated to some extent by abrasive materials normally contained in dentifrices. Brush wear results in tearing, splaying, expansion and fraying of the filaments and a decrease in strength and resiliency of the filaments which is manifested by single filaments deviating from their original direction. Moreover, wear is manifested by a change in the overall shape and size of the brushing surface area and by changes in the texture of the filament. While toothbrush wear varies from use to user, studies indicate that the average toothbrush subject to average use has a useful effective life from about eight to twelve weeks. Thereafter, wear causes sufficient deterioration of the filaments to warrant replacement of the brush in order to assure continued maintenance of effective oral hygiene.

Unfortunately, toothbrushes are not usually replaced regularly and often times are used far beyond their effective useful life. As mentioned, the dental profession has recommended replacement of toothbrushes after about three months of use. However, annual, toothbrush consumption figures indicate that toothbrush user replace their toothbrushes about once a year. The dental profession has made an earnest effort to educate the public about the need to assess the wear of a toothbrush being used to determine if it should be discarded and replaced. However, these efforts have had limited success since the user has the responsibility to remember the condition of a toothbrush which should be discarded and to remember to monitor and continually assess the condition of the toothbrush. Accordingly, a more effective approach is needed to provide reliable means to signal or warn a toothbrush user when a toothbrush has become sufficiently affected by the wear that it should be discarded and replaced.

U.S. Pat. No. 4,802,255 and Pending PCT application Ser. No. 92/04589, both incorporated herein by reference, describe brush filaments, particularly toothbrush filaments which include a colorant which is adapted to provide a color intensity which can change in response to increased use of the filament to provide a signal indicative of filament wear. A line of toothbrushes covered by the claims of these patents has been successfully marketed by Oral-B Laboratories, Redwood City, Calif. under the Indicator$^R$ brand. In the manufacturing methods of these patents, an outer color region is provided by ring dying monofilaments. In a ring dying process, the filament is contacted with a dye for a time sufficient to at least color the outer surface and to also penetrate into a portion of the cross sectional area.

Through a careful investigation of the Indicator$^R$ products we have discovered two previously unknown shortcomings or problems with the product. First, dye penetration is not uniform at different depths along the annular circumference of the bristle. As a result, the darker regions on the outside wear first, while lighter blue persists for a considerable period of time. It would be desirable to have a darker region which is uniform in color density for a fixed depth along the annular circumference of the bristle ring. This would result in a line of clear demarkation of dyed sheath material versus undyed core filament material. The second problem relates to overall dye intensity. During the ring dyeing operation if a high level of dye concentration is used, the resulting bristles are darker; however, the dye material penetrates into the core at a much greater degree. Thus, it is difficult to produce a dark colored, ring dyed material with a thin, dark ring coating.

The following background patents also relate generally to the present invention:

U.S. Pat. No. 2,328,998 to Radford, issued Sep. 7, 1943 discloses an attrition product, e.g., toothbrush filament including a co-mingled abrasive material. FIGS. 3 and 4 disclose a composite filament including a non-abrasive core with a co-mingled abrasive material. FIG. 8 shows a batch-wise apparatus for extruding the filament of FIGS. 3 and 4.

U.S. Pat. No. 3,016,554 to Peterson, issued Jan. 16, 1962 discloses a wire brush filament on to which a plastic coating, e.g., nylon, is extruded as a vibration dampening coating. This bristle is then dip coated with a thin epoxy protective layer. The nylon layer is said to have a general thickness about one half the diameter of the wire core plus or minus 50% (see column 2, lines 67 to 69).

U.S. Pat. No. 3,258,805 to Rossnan, issued Jul. 5, 1966 discloses a wear indicating toothbrush bristle comprised of a nylon filament which is entirely encased within a coating of colored rubber (see column 1, lines 30 to 37). This bristle is said to produce an erasing, instead of grinding, action in cleaning the teeth. Also, it states that the wear on the tips of the bristles gives a visual indication of warning when the brush is ready to be discarded.

U.S. Pat. No. 3,327,339, issued Jun. 27, 1967 and Re. No. 26,688, reissued Oct. 14, 1969 to Lemelson disclose composite plastic filaments formed by extruding different polymers one over the other and each imparting a different useful characteristic to the composite filament (see column 1, lines 11 to 15). The core member is said to be preferably a synthetic textile filament such as nylon. The outer jacket layer is described as a flexible cellular plastic material (see column 2, lines 37 to 41 and Column 4, lines 74 through column 5, line 7). FIGS. 3 and 4 show an element comprising a core made from a more rigid material than the surrounding jacket which is made by simultaneously extruding both the core and jacket as a unitary rod or filament (see column 3, line 74 to column 4, line 20). The jacket is said to comprise the major portion of the filament and is in the order of 0.005 inches to 0.030 inches or greater in outside diameter while the core element or thread is about 0.010 inches in diameter or less (see column 4, lines 70 to 74).

U.S. Pat. No. 3,403,070 to Lewis, issued Sep. 24, 1968, discloses a composite filament. These cellular foam filaments are said to be useful as bristles and mop fibers. The filament comprises an unoriented polyolefin shell and an inner core of polyurethane foam. The shell is described as a coating which has a radius to the annular wall thickness ratio of at least 4 to 1. Furthermore, Applicants believe this coated filament is not an extruded bristle due to the soft, foamy nature of the core material.

U.S. Pat. No. 4,263,691 to Pakarnseree, issued Apr. 28, 1981, discloses a toothbrush bristle comprised of a stiff core made of a hard thermoplastic material such as nylon 6 or high density polyethylene and an outer elastomeric sheath. The sheath is said to be made of a soft thermoplastic such as ethylene vinyl acetate copolymer, polyethylene, poly-vinyl chloride, or natural or synthetic rubbers. Regarding thicknesses, it is disclosed that if the diameter of the core is d and the outer diameter of the sheath is D, then the ratio d:D can be in the range of 1:1.01 to 1:2.5 (column 2, lines 10 to 13). FIG. 4 illustrates a filament of material produced by continuous extrusion molding of a substance suitable for the core and a substance suitable for the sheath of the bristle. The filament may be made into bristles with the stiff core exposed at the ends or with the ends of the stiff core covered by the sheath (see column 2, lines 14 to 28 and FIG. 7).

U K. patent application, Ser. No. 2,137,080, to Weihrauch, assigned to Coronet-Werk Heinrich Schlerf GmbH discloses plastic bristles or filaments for brushes which also change color in response to wear. The filaments disclosed in the U.K. Application are composite filaments and include a colored core completely surrounded by an outer cover material having a color different from the core color. The cover is injection molded directly onto the core. In the disclosed filaments, the core is a reinforcing element and is relatively hard and stiff to control the rigidity of the filament while the outer cover material is softer than the core material and is more susceptible to wear. In use, the cover material becomes worn in the area of the rounded end of the filament and peels or breaks off to expose the core color to signal that the brush should be discarded.

It is an object of the present invention to produce a composite toothbrush filament containing a colored outer sheath and a different colored inner core material which has a clear line of demarkation at a magnification of about 250X.

It is yet another object of the present invention to provide a wear indicating toothbrush filament with a greater degree of color intensity in the core and/or sheath.

It is another object of the present invention to produce striped wear indicating bristles as an alternative to ring dyed bristles.

It is yet another object of the present invention to provide a more efficient method of producing wear indicating bristles.

Still yet another object of the present invention to provide color-change type, wear indicating bristles with a more desirable color change.

These and other objects will be evident by the following:

BRIEF SUMMARY OF THE INVENTION

The invention provides novel, improved wear indicating brush filaments and novel, improved coextrusion process for their manufacture. Essentially, the filaments of the present invention are coextruded filaments which include a longitudinal surface providing a boundary about the cross-sectional area of the filament and the longitudinal surface and/or the cross-sectional area presents a two colored region adapted to provide a visual signal indicative of wear in response to filament use. The filaments can be natural or synthetic materials. In filaments of the present invention, the colored region provides an initial color or color intensity viewable to the user. As wear is produced by continuing use of the filaments, the intensity of the colored region changes to a point which signals the user that the filament no longer provides the requisite performance characteristics for effectively performing its assigned function.

DETAILED DESCRIPTION OF THE PRESENT INVENTION

As used herein, the term "core" refers to the central portion of a bristle material as examined at the cross-section. The FIGS. designate the core as 28.

As used herein, the term "sheath" refers to an outer coating layer(s) over the core material 28 on a bristle. The Figures designate sheaths as 26 and 32. Preferably the sheath provides a uniform coating around the entire perimeter of the core. However, also encompassed in the present invention, are bristles wherein the sheath material only partially covers the perimeter, forming a stripe(s) or spiral(s) down the length of the bristle material. Preferably, the sheath region extends inwardly into a portion of the overall cross-sectional area of the filament for a distance equivalent to about 10 per cent or less of the filament diameter.

Although bristles have been produced by coextrusion in the past, these processes suffered from at least two shortcomings. First, the bristle materials were made of radically different core and sheath materials and/or processing conditions which resulted in severe failure of the sheath upon wear. Secondly, the coating materials were too thick. Applicants have alleviated these problems by coextruding the bristles through the use of a coextruding die in combination with shorter contact times, preferably through the additional use of a rotating coextruder die head.

Figure 1:
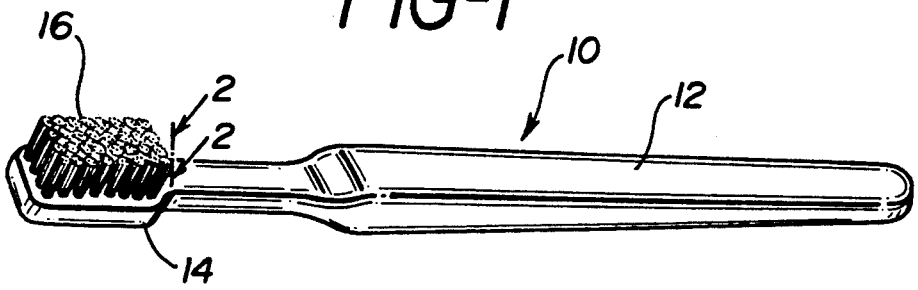
FIG. 1 is a diagrammatic perspective view of a representative toothbrush including the novel filaments of the invention.

In a preferred toothbrush embodiment of the present invention, the novel filaments are included in toothbrushes of the type shown in FIG. 1. The toothbrush shall have at least one tuft securely affixed in or attached to the head, said tuft including a plurality of filaments according to the present invention. As shown there, the toothbrush 10 includes a handle 12 and a head 14 having a plurality of tufts 16. Tufts 16 comprise a plurality of individual filaments and, tufts 16 are securely affixed in or attached to head 14 in manners known to the art. The configuration of head 14 and tufts 16 can vary and may be oval, convex curved, concave curved, flat trim, serrated "V" or any other desired configuration. Additionally, the configuration, shape and size of handle 12 or tufts 16 can vary and the axes of handle 12 and head 14 may be on the same or a different plane. The longitudinal and cross-sectional dimensions of the filaments of the invention and the profile of the filament ends can vary and the stiffness, resiliency and shape of the filament end can vary. Preferred filaments of the present invention have substantially uniform longitudinal lengths between about 3 to about 6 cm., substantially uniform cross-sectional dimensions 24 between about 100 to about 350 microns and have smooth or rounded tips or ends.

Figure 2:
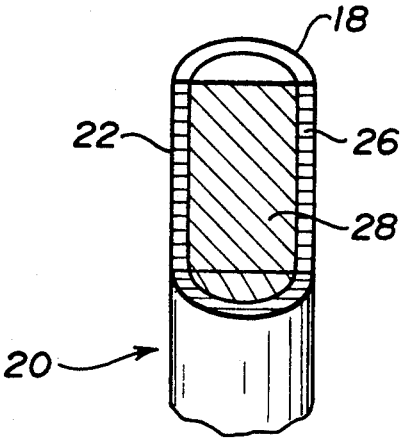
FIG. 2 and 3 are magnified, diagrammatic views of novel filaments of the invention taken along line 2—2 of FIG. 1 with a portion of the filaments broken away.
Figure 4:
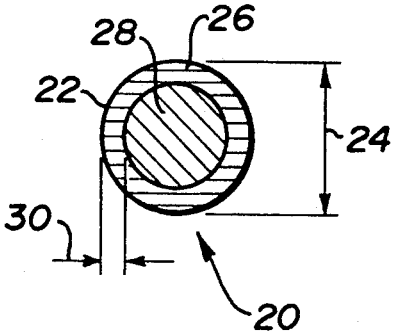
FIGS. 4 and 5 are magnified, diagrammatic cross-sectional views of filaments of FIGS. 2 and 3 respectively.

FIGS. 2 and 4 diagrammatically represent a most preferred filament of the present invention. As shown in the Figures filament 20 includes longitudinal surface 22 which terminates at a tip or end 18 and defines the boundary of the cross-sectional area 24 of the filament. Cross-sectional area includes two colored regions 26 and 28 which have different color or different intensities. As used herein the term "colored region" can mean a core or sheath material which is colored by a colorant prior to being extruded. It can also mean a core or sheath which is made of a plastic with a unique color. Furthermore, transparent or translucent regions are also considered by be "colored" as they are at least of different optical appearance than a truly pigmented or dyed region, as is also the case for a sheath/core varying degrees of color intensity. However, it is important that the core 28 and sheath 26 materials have visually different color, e.g., white core and blue sheath, transparent core and red sheath, light red core and dark red sheath, etc. Preferenced bristles according to the present invention comprise a white or transparent core and a dyed or pigmented sheath.

Typically, a colored region 26 extends at least about surface 22 or preferably extends from surface 22 inwardly into a portion of cross-sectional area 24 to a distance 30 (FIG. 4) of region 26 into cross-sectional area . Preferably, colored region 26 provides an annular ring having a substantially uniform depth 30. Most preferably, this depth should not vary more than 20%, preferably not more than 10%, from the mean depth around the annular ring. In either event, colored core region 28 occupies the remaining portion of the overall cross-sectional area defined by maximum diameter 24. Accordingly, sheath color region 26 provides an initial color intensity or color which is predominant and more conspicuous to the toothbrush user while the color intensity of core region 28 is less conspicuous. However, in response to wear produced by progressive brushing, the region 26 wears, and after sufficient wear the perceived change in color of the bristle to that of core region 28 signals the user that the filament is no longer effective.

As was mentioned previously, colorants can be added to the core and/or sheath of the present invention. These colorants can be dyes or pigments. Preferred dyes providing region 26 are food dyes or certified food colorants. Suitable food dyes or colorants are F D & C red No. 40, erythrosine (F D & C red No. 3), brilliant blue F C F (F D & C blue No. 1), indigotine (F D & C blue No. 2), tartrozine (F D & C yellow No. 5), sunset yellow F C F (F D & C yellow No. 6) and fast green F C F (F D & C green No. 3). The thermal stability of these materials is less of a concern due to the relatively short contact times of the present process Suitable pigments for use as colorants include any food grade pigments, such as titanium dioxide, metal flake pigments and nacreous pigments which impart a pearl luster. For a further discussion of colorants see Juran, Modern Plastics Encyclopedia. Vol. 67 (11), pp 167–175 (October 1990).

The core and sheath of the present bristles can be extruded from a variety of polymeric materials. Preferably these materials are polyamides, acetal resins, such as Delrin 900 (mfg. DuPont) and polyesters, such as Rynite 530, Rynite 545, Rynite 555 (mfg. by Dupont). Most preferably, the core and sheath are extrusions of Nylon 616, preferably Zytel 158L, Zytel 330 or Zytel ST901, all manufactured by Dupont. Preferably the core and sheath are of the same material. Optionally, other additives known to those skilled in the art may be added to the bristle material such as polyethylane glycol, antioxidants, plasticizers, etc.

The thickness of the sheath material 30 is coordinated with the wear characteristics of the filament so that the change in color provides a reliable indication of filament deterioration due to 12 weeks of typical wear. In general, with nylon core/nylon sheath filament, suitable coordination between the sheath thickness and colorant fastness (if any) and filament wear characteristics can be achieved if region 26 (FIG. 2) has an average depth equal to about 10% or less of the filament diameter. Preferably the average depth 30 is equal to about 5% or less of the diameter, especially when dealing with nylon/nylon filaments with a dye such as indigotine, also known as FD C No. 2.

Figure 3:
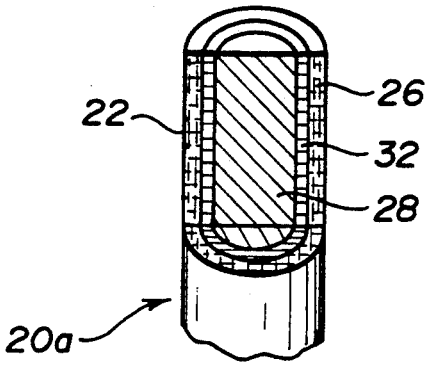
Figure 5:
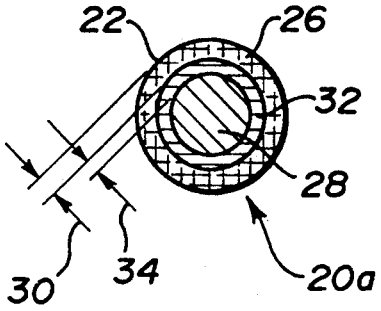

Filaments of FIGS. 2 and 4 may also be prepared with combinations of colored regions, each colored region providing a unique color intensity having substantially the same resistance to change in response to wear and use wherein the alternative each dye may provide a color intensity having a different resistance to change in response to wear and use. For example, as in FIGS. 3 and 5, a filament may be prepared with two colored sheath regions in which one colored layer 26 is more resistant to change in response to wear and use than the other 32. In this case the color of the outer region **26*a*** will abrade in response to wear and use to provide a color which will be predominantly provided by the more resistant colored region.

Another embodiment is a bristle wherein the sheath material only partially covers the perimeter. When a stationary die head is used, this would result in a bristle which has stripe(s) down the length of the bristle. When a rotating die head is used, this would result in a bristle which has sprial(s) down the length of the bristles. Optionally, a plurality of different colored bristle stripe(s) or spiral(s) may be utilized for greater visual impact.

Figure 6:
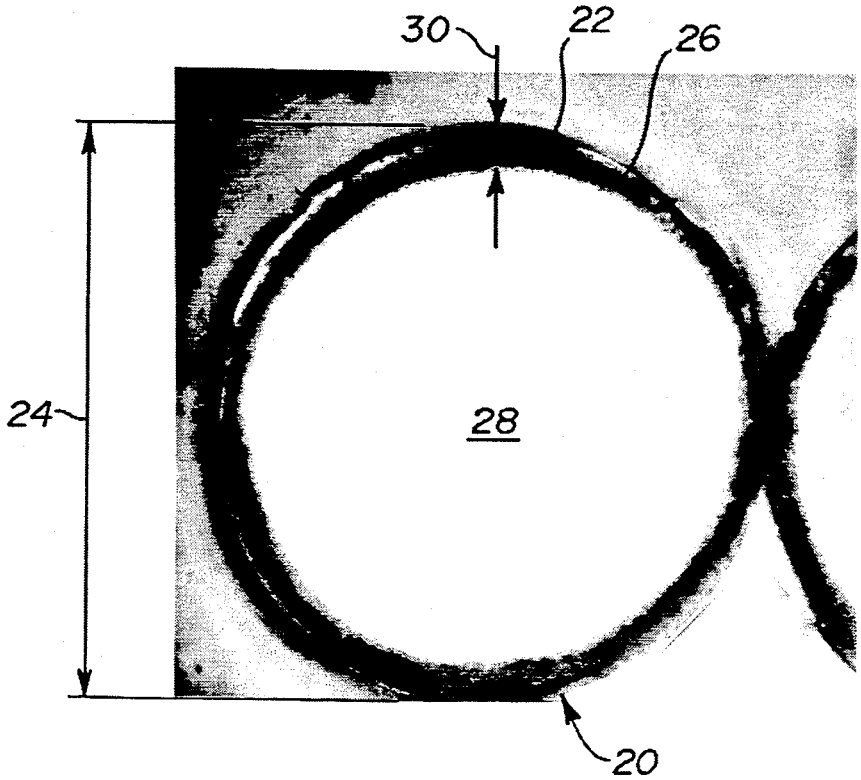
FIGS. 6 and 7 are photomicrographic cross-sectional views of filaments according to the present invention and ring-dyed filaments according to U.S. Pat. No. 4,802,255, respectively. Magnification is about 250X.
Figure 7:
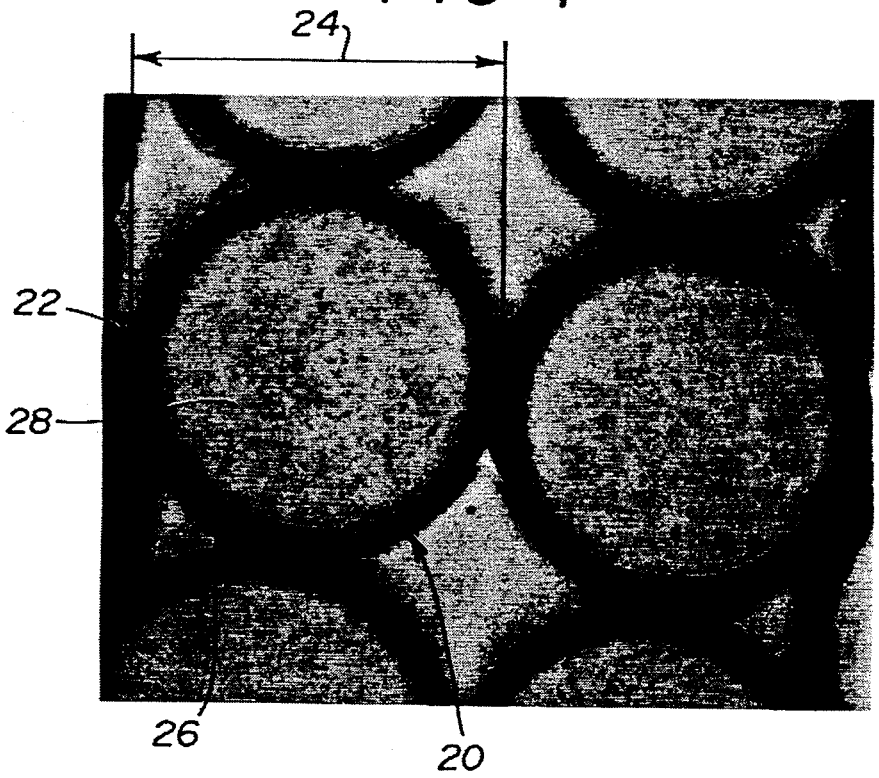
Figure 8:
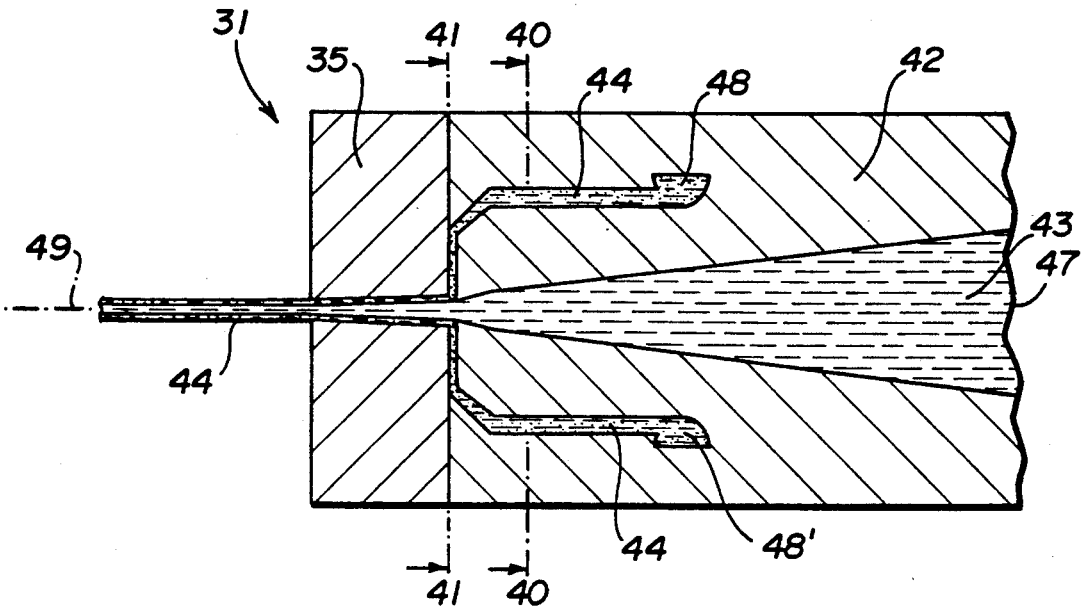
FIG. 8 is a cross-sectional side view of an extrusion dye head suitable to produce the filaments of the present invention.

The bristle filaments of the present invention are produced by a coextrusion process. For a general discussion of coextrusion technology see Levy, *Plastics Extrusion Technology Handbook,* Industrial Press Inc., pages 168–188 (1981), incorporated herein by reference. FIG. 8 shows a schematic cross-sectional view of a coextrusion filament die 41. The die head unit comprises the core orifice 42, the sheath orifice 35. The sheath material inlet manifolds 48 and 48', and the core inlet manifold 47. Typically the entire die is heated. The best condition for making coextruded bristles is to have the melt viscosity of both resins, core 43 and sheath 44, as close together as possible at the point of stream combination. This results in the minimum disturbance at the interface between the two materials and results in a clear line of demarkation along the cross-sectional area at a magnification of about 250×. A sharp interface between the core and the sheath can also be produced by adjusting contact time, material grades or by using different resins. This can clearly be seen in photomicrograph FIG. 6.

In a preferred coextrusion unit according to the present invention, the system includes a coextrusion die as shown in FIG. 8 which includes a cross head sheath die which rotates about the axis of extrusion 49. The set up also includes two ¾" Haake extruders, a cooling trough, a puller and a winder. Each extruder is equipped with a screw with a L/D ratio of 25:1 and a compression ratio of 3:1 and a 5 HP motor capable of operating at screw speeds and processing temperatures of up to 250 rpm and 500° C., respectively. Each extruder incorporates six temperature controllers to control processing temperatures. The extrusion die has a core orifice 42 without exit diameter of 0.080 inches and a sheath orifice 35 with an exit diameter of 0.085 inches. The core melt 43 is uncolored nylon (Zytel 158L) and the sheath melt 44 is a 1% indigotines/nylon blend. Both melts and the die 31 are maintained at a temperature of 190°–230° C. The core extruder operates at 20 rpm, 608 psi; and 5263 m.gm torque. The sheath extruder operated at 2 rpm, 1827 psi and 1416 m.gm torque. The screw speeds are optimized to minimize interfacial shear stresses. The particular connections between these physical properties would be apparent to one skilled in the art. Furthermore, a full production line in this area will also include additional processing hardware for orienting (draw process), annealing and finishing.

Finally, to produce a 0.008" filament from the above extrusion dye (orifice equals 0.085") the draw down ratio is set at 10.625:1. By employing this technique the thickness of the outer sheath layer 26 ranges from 0.0001" to 0.0004", and can be produced at a diameter of 0.0002"plus or minus 20%, typically plus or minus 10%. This highly uniform coating layer thickness is achieved by optimizing the ratio of the two extruder speeds and cross-head design. For example, to extrude the above-mentioned 0.008" nylon bristles with a layer thickness of 0.0002", the ratio of the screw speed (sheath/core) is set at 10:1. Increasing the ratio results in a thinner outer layer up to a point when the outer layer becomes discontinuous, while increasing both screw speeds increases dye pressure and ends up degrading polymeric material. On the other hand reducing both screw speeds lowers the die pressure but reduces input. A discontinuous outer layer would of course appear as a stripe down the side of the bristle. Optionally a gear pump can be added to meter the materials more precisely.

Figure 10:
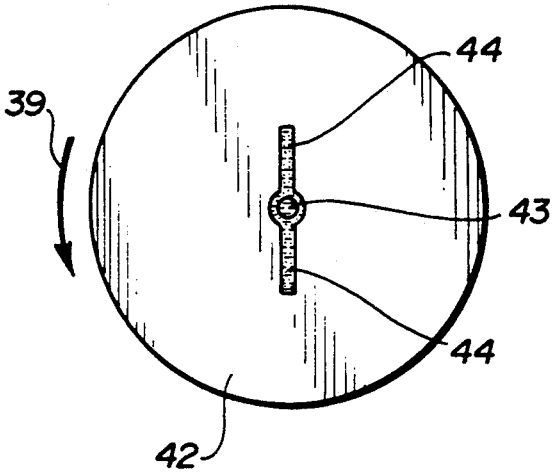
FIG. 10 is a head-on cross-sectional view of the dye head of FIG. 8 taken along line 41—41.
Figure 9:
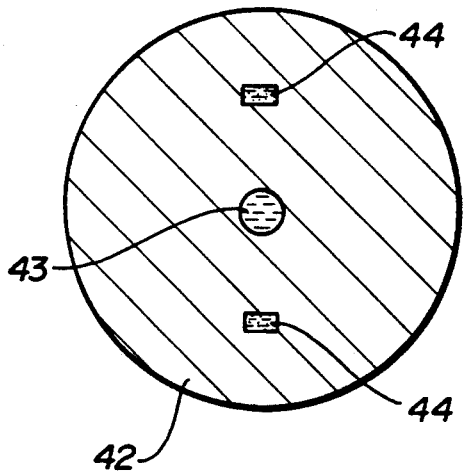
FIG. 9 is a head-on cross-sectional view of the dye head of FIG. 8 taken along line 40—40.

As mentioned previously, the die may incorporate a rotating sheath orifice 45 to produce a more uniform coating on the filament. The technique involves rotating the outer frame (sheath frame) of a coextrusion die of from about 0.5 to about 50 RPM's depending on the rheological properties of the polymer used for forming the outer layer. When coating nylon bristles like the ones described above, a rotational speed of from about 0.5 to about 10.0 is utilized, most preferably from about 0.5 to about 5.0. A chain sprocket is added to the dye for the frame rotation. During the filament coextrusion the sprocket is rotated at a set speed controlled by a motor with a chain drive. This is depicted as the rotation arrow 39 in FIG. 10. This frame rotation helps disperse the melt stream in the outer layer, thereby producing a uniform ultra thin layer. When the sheath screw speeds are metered back, discontinuous sheath coatings are produced. On a rotating die, this results in a swirling stripe around the filament similar to a barber's pole. Either of these concepts could also be used as a wear indicating bristle.

Applicants consider equivalent embodiments to be part of the present invention. For example, noncircular bristles, such as square, hexagonal, or other geometric cross-sections, are also contemplated by the present invention. The invention and manner of making and using the invention will be more fully appreciated from the following non-limiting, illustrative examples:

SELECTED EXAMPLES

| | Overall Diameter (inches) | Sheath Thickness (inches) | Core Material | Sheath Material |
|---|---|---|---|---|
| 1) | .008 | .003 | Zytel 158 | 2% blue, Zytel 158, 1% Ti02 |
| 2) | .008 | .003 | Zytel 158 | 3% blue, Zytel 158, 1% Tio02 |
| 3) | .008 | .003 | Zytel 158L | Zytel 158L (blue) |
| 4) | .012 | .001 | Zytel 330 | Zytel ST901 (Black) |
| 5) | .008 | .003 | nylon | EVA (black) |
| 6) | .008 | .003 | Zytel 158L | EVA (blue) |

What is claimed is:

1. A toothbrush including a handle associated with a head having at least one tuft securely affixed in or attached to the head, said tuft including a plurality of filaments comprised of a first colored core region and a second colored sheath region which extends along at least a portion of the outer surface of the filament and further extends inwardly into a portion of the cross-sectional area for a distance equivalent to about 10 percent or less of the filament diameter, wherein said second colored sheath region is bound to said first colored region, and wherein the sheath region and the core region are comprised of nylon.

2. A toothbrush of claim 1 wherein the second colored sheath region extends along the entire longitudinal surface.

3. A toothbrush of claim 2 where the second colored region provides an annular ring extending inwardly for a substantially uniform distance.

4. A toothbrush of claim 3 wherein at least one colored region is provided by a colorant.

5. A toothbrush of claim 4 where the colorant is a food dye.

6. A toothbrush of claim 5 wherein the sheath region and core regions are applied by coextrusion.

* * * * *